United States Patent [19]

Schrödl

[11] Patent Number: 4,793,560

[45] Date of Patent: Dec. 27, 1988

[54] METHOD AND APPARATUS FOR ADJUSTING THE GAP WIDTH OF A CONE-TYPE CRUSHER

[75] Inventor: Hermann Schrödl, Gallspach, Austria

[73] Assignee: Fried. Krupp Gesellschaft mit beschränkter Haftung, Essen, Fed. Rep. of Germany

[21] Appl. No.: 61,434

[22] PCT Filed: Sep. 9, 1986

[86] PCT No.: PCT/EP86/00519

§ 371 Date: May 11, 1987

§ 102(e) Date: May 11, 1987

[87] PCT Pub. No.: WO87/01305

PCT Pub. Date: Mar. 12, 1987

[30] Foreign Application Priority Data

Sep. 10, 1985 [AT] Austria ..... 2634/85

[51] Int. Cl.[4] ..... B02C 2/00

[52] U.S. Cl. ..... 241/30; 241/37; 241/207

[58] Field of Search ..... 241/30, 37, 207–216

[56] References Cited

U.S. PATENT DOCUMENTS

| | | | |
|---|---|---|---|
| 2,941,732 | 6/1960 | Cross et al. | 241/37 X |
| 3,078,051 | 2/1963 | Patterson . | |
| 3,328,888 | 7/1967 | Gieschen | 241/37 X |
| 3,436,654 | 4/1969 | Thiele | 241/37 X |
| 3,700,175 | 10/1972 | Saito | 241/37 |
| 3,944,146 | 3/1976 | Stockmann et al. | 241/37 X |
| 4,251,035 | 2/1981 | Chatwin et al. | 241/37 |
| 4,272,030 | 6/1981 | Afanasiev | 241/37 |

FOREIGN PATENT DOCUMENTS

| | | | |
|---|---|---|---|
| 2051398 | 4/1972 | Fed. Rep. of Germany . | |
| 55-005718 | 1/1980 | Japan . | |
| 57-135050 | 8/1982 | Japan . | |
| 625770 | 9/1977 | U.S.S.R. . | |
| 893264 | 12/1981 | U.S.S.R. . | |
| 1049103 | 10/1983 | U.S.S.R. | 241/37 |
| 1080085 | 8/1967 | United Kingdom . | |

OTHER PUBLICATIONS

Patent Abstract No. 53-137467 by Kawasaki Jukogyo K.K.; 11-30-78.

*Primary Examiner*—P. W. Echols
*Assistant Examiner*—Joseph M. Gorski
*Attorney, Agent, or Firm*—Spencer & Frank

[57] ABSTRACT

A method and apparatus for adjusting the gap width between a rotatable crusher cone and a crusher housing includes determining a reference position of the crusher cone relative to the crusher housing, storing a first quantity representative of the reference position, rotating the crusher cone, moving the crusher cone to the reference position, moving the crusher cone from the reference position toward the crusher housing until a limit is reached and measuring the distance of the crusher cone from the reference position, storing a second quantity representative of the distance, repeating the preceding three steps a plurality of times while separately storing each of the second quantities, obtaining a new reference position based on each of the second quantities, and determining an operating position of the cone crusher based on the new reference position. The apparatus includes a control device, a memory, a position detecting device for detecting the position of the crusher cone, and an apparatus for detecting whether the crusher cone is moving.

10 Claims, 1 Drawing Sheet

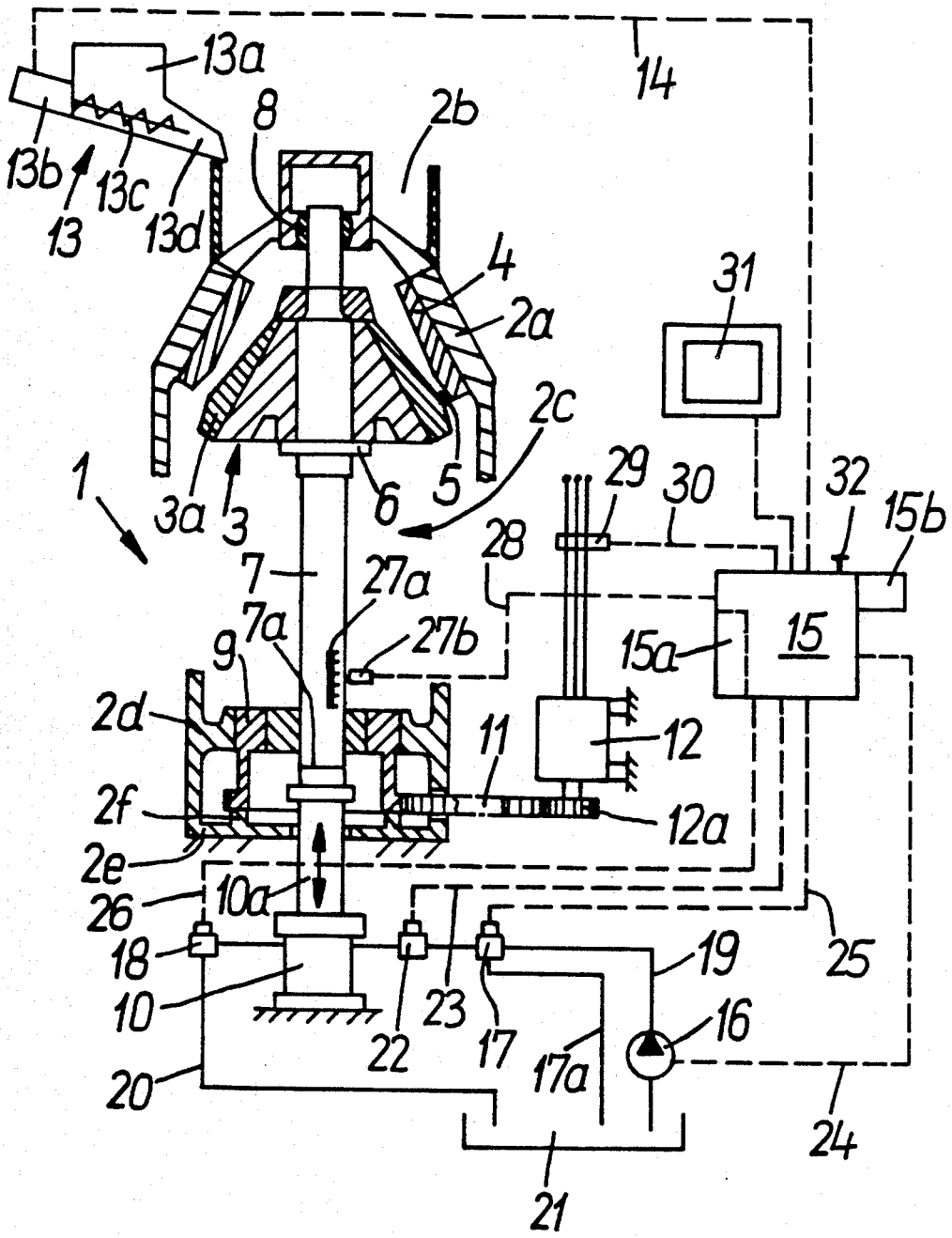
13a
14
8
2b
13b
13c
13
13d
4
31
2a
2c
1
3a
3
6
5
29
30
32
15b
28
7
27a
7a
27b
15a
15
9
2d
11
12
2f
12a
2e
26
10a
25
18
19
10
23
16
22
17
17a
20
24
21

METHOD AND APPARATUS FOR ADJUSTING THE GAP WIDTH OF A CONE-TYPE CRUSHER

The invention relates to a method for the adjustment of the gap width of a cone-type crusher or the like, having a crusher cone rotating tumblingly and being height-adjustable in respect to the crusher housing. The crusher cone, by approaching the crusher housing, can be brought into a reference position and an operating position. The travel of the crusher cone is determined corresponding to a set gap width by which the crusher cone should be distant from the reference position to the operating position. The approach of the crusher cone to the crusher housing is detected by means of a movement detection measurement and the respective crusher cone position is determined by means of a distance measurement.

The gap width, i.e. the width of the crusher discharge gap between the stationary crusher housing and the crusher cone located approximately concentrical on the inside of said crusher housing is of decisive importance for crushing effect and crushing performance of a cone-type crusher or a crusher of similar construction: if the crusher gap width is small, the material to be crushed is crushed more finely than if the crusher gap is larger.

Because of the wear of the crusher cone and crusher housing occurring during operation, the width of the crusher gap changes, with the result that the crushed product slowly shows increasing coarseness. Account of this unwanted effect must be taken by resetting the gap width at least periodically to a set value.

The axial inclination of the crusher cone results in its having a smallest and a largest distance, with corresponding transition zones, from the stationary crusher housing; the point forming the smallest distance is referred to as the effective width of the crusher gap.

In a known method, described in British Pat. No. 1,080,085, the gap width is set, with the crusher cone at rest, by means of a movement detection measurement in the form of a pressure measurement and by a distance measurement such that the crusher cone is first brought to the crusher housing until it touches it and, based on the reference position thus determined, a movement of the crusher cone away from the crusher housing corresponding to a predetermined gap width is initiated. Attainment the reference position is determined via a pressure sensor installed in the circuit of the hydraulic shifting drive of the crusher cone; the amount of travel performed during the opening movement into the operational position is determined by means of the measurement of the volume of liquid displaced by the opening movement. The width of the crusher gap and the amount of wear can be determined by an inductive distance measurement; this is accomplished by means of a measuring piston which penetrates into a coil to a larger or smaller degree. The known method can also be operated automatically according to a preset program, either after every stopping of the crusher cone or less often.

A method for the electrical determination and adjustment of the gap width of a cone-type crusher is already known, for example, from German Laid-Open Application DE-OS 20 51 398.

SUMMARY OF THE INVENTION

It is an object of the invention to describe a method and the components necessary for its operation by which the accuracy of setting the width of the crusher gap is improved. The method should especially be such that, if possible, different types of wear of the crusher cone and/or crusher housing can be taken into consideration when adjusting the gap.

The object is attained by performing successively several approach cycles with the crusher cone rotating, each cycle consisting of the approach of the crusher cone to the crusher housing and the subsequent opening movement away from the crusher housing, and to use the approach values gained with every approach cycle for the formation of a reference value fixing the reference position. On the basis of this reference value, that position of the crusher cone is determined which it should have to maintain the operating position in a desired gap width.

The approach operations conducted in the framework of the approach cycles can either be such that, if need be, the rotating crusher cone comes to rest momentarily against the crusher housing or is kept momentarily (especially by means of a layer of test material) at a short, reproducible distance from the crusher housing. In accordance with the invention the determination of the reference position can therefore be based on attaining a momentary touching position (when reaching the "zero gap width") or an almost touching position (when reaching the "almost zero gap width") between the crusher cone and crusher housing.

By "movement detection measurement" in the sense of the method according to the invention is meant a measuring or sensing method or the like which shows whether the crusher cone has finished its respective approach operation within the framework of the predetermined number of approach cycles, i.e. that it has stopped (if there is no malfunction) against the crusher housing or close to the crusher housing.

Collection of the measurements important for the method and control of the associated component (drives, valves) is appropriately performed via a control unit into which a computer having sufficient memory capacity has been integrated.

The end of the approach of the crusher cone directly against the crusher housing or approximately towards it via a layer of test material can be measured—especially inductively—via a speed measurement and/or via a pressure measurement—for example in the pressure system of a hydraulic shifting drive of the crusher cone. The respective position of the crusher cone in respect to the stationary crusher housing can be determined, for example, by the previously noted known distance measuring methods.

The method is preferably structured such that a mean value is formed from associated approach values, which constitutes the reference value; the mean value can especially be calculated from the arithmetic or the quadratic mean of the associated approach values.

The method of the invention, however, can also be practiced in such a way that from the associated approach values a certain approach value is selected as a reference value, namely the one showing the greatest displacement of the crusher cone in the direction of the crusher housing determined during the approach cycles.

In an advantageous embodiment of the method the crusher cone, at least after the end of each approach cycle or if desired before the first approach cycle, is first brought into a predetermined opening position which deviates from the reference position. The advantage of this procedure can be seen in the fact that each approach cycle, i.e. the approach of the crusher cone to the crusher housing and the subsequent return to the predetermined opening position, takes place under similar conditions.

Additionally, the distance between the opening position and the reference position can be kept constant. This can, for example, be done by adapting the location of the opening position to the change noticed after the reference position has been determined. If the changing values for the location of the opening position or the reference position are stored and shown in the form of a curve, the development of wear in the associated time period (to which the respective positions are to be associated) can be read from it and a reference point for future wear development can also be obtained.

The method can be advantageously developed in this context such that the stored opening position values or reference position values are compared with a predetermined limiting value. Reaching this limiting value serves as a signal, for example optical or accoustical, that the worn part of the cone-type crusher (crusher cone, crusher housing) must be replaced.

In a number of applications it is sufficient to trigger the checking and adjustment of the gap width by hand at a suitable time after the cone-type crusher is empty. The adjustment procedure is performed such that first the supply of material to be crushed to the cone-type crusher is interrupted, before the approach cycles for the determination of the desired reference position automatically start, with a sufficient time delay. Preferably the approach cycles and the subsequent movement of the crusher cone into the operating position are automatically started in predetermined time intervals, the first approach cycle starting with a time delay for the interruption of the supply of the material to be crushed.

The already mentioned storage of the reference positions or the opening positions adapted to them is advantageous to the degree that false measurements (for example generated by foreign materials) can be detected by comparison with the stored position values and can be suppressed as not usable.

If the approach operations always start from the same known opening position, it is possible to check by means of repeated time of travel measurements whether the crusher cone has at least traveled a known distance up to the time of stopping.

The determination of reference positions can also be accomplished such that the crusher cone is only brought into the vicinity of the crusher housing in the course of the approach cycles. Each of these approach procedures end as soon as the rotating crusher cone rests against the crusher housing over a layer of test material of a known coarseness. The layer cooperating in the formation of the reference position can be made by introducing, at least during the approach procedures, test material in sufficient quantity into the crusher discharge gap, instead of the material to be crushed. The method variant under discussion has the advantage that the determination of the reference position takes place without contact between the rotating crusher cone and the stationary crusher housing.

BRIEF DESCRIPTION OF THE DRAWING

The invention is described in detail below with reference to the FIGURE of the drawing, in which a cone-type crusher with components used in a method of operation being shown schematically.

DETAILED DESCRIPTION OF THE PREFERRED EMBODIMENT

The housing of a cone-type crusher 1, in connection with which the method of the invention is used, includes an upper housing part 2*a* with a supply inlet 2*b* and a discharge opening 2*c*, an adjoining central housing part 2*d* only partially shown, and a lower housing part 2*e* having an upwardly oriented axial bearing 2*f*.

A crusher cone 3 is disposed pivotably and adjustable in height inside the housing, its replaceable cone casing 3*a* and a crusher housing 4 in the form of a truncated cone and replaceably fixed to the upper housing part 2*a* forming a cone discharge gap 5. The crusher cone 3 is fixedly fastened by means of an attachment ring 6 to a shaft 7 which, in turn, is secured via a pivot bearing 8 which is disposed on the upper housing part 2*a*. The shaft is supported by a radial bearing of a rotating drive housing 9 on the central housing part 2*d* and, at its downwardly directed front face 7*a*, on a height-adjustable piston 10*a* which is driven by a stationary hydraulic cylinder 10. The drive housing 9 is provided with a gear ring and rests on the axial bearing 2*f*. The drive housing 9 is connected, via a drive element in the form of a toothed belt 11, with a pinion 12*a* of a three-phase A.C. motor 12.

The shaft 7 is eccentrically supported within the drive housing 9 because of the eccentric support of the shaft 7 in the drive housing 9, the crusher cone 3 has a tumbling motion inside the crusher housing 4 when the three-phase A.C. motor 12 is operated, the narrowest spot between the parts 3*a* and 4 being referred to as a cone discharge gap 5, the cone discharge gap 5 rotating during operation with respect to the crusher housing 4.

A conveyor element 13 is placed ahead of the supply inlet 2*b*, including a hopper 13*a*, a spiral conveyor 13*c* driven by a conveyor motor 13*b* and a conveyor chute 13*d* terminating in the supply inlet 2*b*. The conveyor motor 13*b* is connected via a control line 14 with a control element 15, with which is integrated a computer 15*a* having a timer control unit 15*b* and sufficient storage capacity for the timed monitoring and control of the method steps.

The motive power supply system for the hydraulic cylinder 10 includes a motor-driven hydraulic pump 16, two remote-controlled valves 17 and 18 which are, respectively, installed in the pressure line 19 and the return line 20 of the hydraulic cylinder 10, and an oil reservoir 21 in which terminate the lines 19 and 20 as well as the return line 17*a* of the valve 17. A pressure sensor 22 is switched upstream of the valve 17 in the direction of the hydraulic cylinder 10 and is connected via a signal line 23 with the control element 15. The components 16 to 18 are respectively connected with the control element 15 via signal lines 24, 25 and 26.

The respective position of the crusher cone 3 in relation to its stationary surroundings is measured by means of a distance measuring unit consisting of a measuring element 27*a* fastened on the shaft 7 and a stationary distance measuring sensor 27*b* which is connected via a measuring line 28 to the control element 15.

In order to be able to draw conclusions, if required, in regard to the operational state of the cone-type crusher 1 from the power consumption of the three-phase A.C. motor 12, a current-measuring device 29 is associated with the said drive, the measured values of which can be entered via a signal line 30 into the control element 15 and processed there.

Certain data stored in the computer 15*a* can, if required, be displayed by means of a view screen 31 connected to the control element 15.

In order to manually start the checking and adjustment of the crusher discharge gap, if required, the control element has a manual switch 32.

The method of the invention proceeds as follows:

By actuation of the manual switch 32 the conveyor motor 13*b* is first stopped via the control element 15 and the control line 14, thereby interrupting the supply of the material to be crushed into the area of the inlet opening 2*b* of the cone-type crusher 1 while the crusher cone 3 continues to tumblingly rotate and to crush the remaining material received which is to be crushed. The measured value corresponding to the working position of the crusher cone 3 which is picked up by the distance measuring sensor 27*b* has already been stored in the memory 15*a* during the preceding adjustment of the crusher cone to the present working position.

The crusher cone 3 is lowered into an opening position, which is predetermined by the memory 15*a* after a predetermined selectable time delay via a delay member, not shown, forming a part of the control element 15. The predetermined selectable time delay occurs after the actuation of the manual switch 32, and actuates the piston 10*a* by closing of the valve 17 and opening of the valve 18. The time delay is selected so that with sufficient assurance the cone-type crusher 1 does not contain in the area of components 3 and 4 any material to be crushed, i.e. it is empty.

After reaching the opening position the crusher cone 3 is momentarily brought into contact with the crusher housing 4 by an appropriate switching of the hydraulic pump 16 as well as of the valves 17 and 18 in several subsequent approach cycles and then returned to the predetermined opening position. The approach values corresponding to the contact on the crusher housing 4 are collected by the distance measuring sensor 27*b* and are stored in the computer 15*a*. After the last approach cycle, which ends with the return of the crusher cone into the said opening position, the arithmetic mean value is formed in the computer from the approach values sensed, which represents the reference value fixing the reference position of the crusher cone and which is also stored.

By a comparion of the reference value and of a value corresponding to the operational position which is also stored in the computer a distance value is determined corresponding to a predetermined gap width by which the crusher cone 3 must be distant from the reference position. The adjustment movement required of the shaft 10 is in turn caused by an appropriate adjustment in the height of the piston 10*a* as monitored by the distance measuring sensor 27*b* the piston 10*a* being locked in the new adjusted position assumed.

The new distance measuring value is stored which corresponds to the working position is also stored.

The approach of the crusher cone 3 to the crusher housing 4 when valve 18 is closed is sensed via the pressure sensor 22 which inputs the pressure increase in the hydraulic cylinder 10 via the measuring line 23 to the control element 15. On the basis of this and by the appropriate operation of the valves 17 and 18, the control element 15 causes the return of the crusher cone 3 to the opening position already mentioned.

The timer control unit 15*b* can be used to assign the stored values for the reference position and/or the working position to the associated time intervals. In this way it is possible to display, for example, the stored values for the working position of the crusher cone 3, applied over time, on the view screen 31 and to obtain from this an indication of the wear so far present on the components 3*a* and 4.

However, the timer control unit 15*b*, together with the distance measuring elements 27*a*, 27*b*, can also be used to monitor the approach operations during the approach cycles. To the extent that there are no false measurements, the crusher cone 3 can only touch the crusher housing 4 when the approach operation has ended, i.e. when the distance measurement value recorded by the distance measuring sensor 27*b* no longer changes in respect to the time set by the timer unit 15*b*. By cooperation of the components 27*a*, 27*b* and 15*b*, false measurements can be prevented if, at the same time, by comparison with already stored approach values, a check is made whether the crusher cone has traveled a minimum distance in the direction towards the crusher housing 4.

Other than in the method just described, the checking and adjustment of the gap width can also be automatically started and completed with the participation of the timer unit 15*b*. For example, the timer unit can be set such that it independently starts the method of the invention once a day.

The method of the invention also can be designed in such a way that in addition to or in place of the pressure measurement by means of the pressure sensor 23, an inductive measuring operation is used, such as is, for example, known from the German Laid-Open application mentioned above. By use of a measuring piston which, depending on the movement of the crusher cone 3, penetrates more or less deeply into a stationary coil, not only a change in distance travelled but also movement can be detected; for instance, it can be determined whether the crusher cone 3 has stopped after touching the crusher housing 4.

However, the movement of the crusher cone 3 into a predetermined working position can also be accomplished on the basis of a reference position where the tumblingly rotating cone crusher 3 only almost touches the crusher housing 4.

In order to obtain reproducible approach values for the determination of such a reference position with sufficient accuracy, testing material of known coarseness is first supplied via the conveyor unit 13 to the input opening 2*b* after emptying the cone-type crusher 1 at least during the approach cycles. The test material forms a layer in the gap area on top of which the crusher cone 3 is only indirectly supported against the crusher housing 4. Although this method entails additional effort, it has the advantage that a reference position of the crusher cone 3 can be determined via reference values without it having to touch the crusher housing 4 during the chronological approach cycles.

To the extent that the location of the opening position is respectively adapted to the changing reference position and the corresponding values are stored, a result can be obtained, by comparison of the stored values with a limiting value, for the opening position as to the amount of wear present or whether replacement of the cooperating wear components 3*a* and 4 is required.

The main advantage of the method of the invention consists in determining the reference value, based on which a predetermined working position of the crusher cone is controlled by several approach cycles representing sensing operations, and while the crusher cone 3 is rotating. Since several reference values are chronologically determined, an uneven wear of the two cooperating wear components is also included in the reference value and thus influences the adjustment of the width of the crusher discharge gap 5.

I claim:

1. A method for adjusting the gap width between a rotatable crusher cone and a crusher housing, comprising the steps of:

(a) determining a reference position of the crusher cone relative to the crusher housing;

(b) storing a first quantity representative of said reference position;

(c) moving said crusher cone to said reference position;

(d) moving said crusher cone from said reference position toward said crusher housing until a limit position is reached, stopping the movement of said crusher cone toward said crusher housing when the limit position is reached, and measuring the distance between said reference position and said limit position;

(e) storing a second quantity representative of said distance;

(f) repeating steps (c)–(e) a plurality of times while separately storing each of the second quantities;

(g) obtaining a new reference position by analyzing each of said second quantities in conjunction with each other;

(h) determining an operating position of said cone crusher based on said new reference position;

(i) moving said crusher cone to said new operating position; and (j) performing steps (c)–(i) while continuously rotating said crusher cone.

2. A method as claimed in claim 1, wherein in step (d) said limit position is reached upon contact of said crusher cone with said crusher housing, said contact being detected by measuring movement of said crusher cone.

3. A method as claimed in claim 1, wherein in step (d) said limit position is reached upon contact of said crusher cone with said crusher housing, said contact being detected buy measuring pressure of a fluid which causes movement of said crusher cone.

4. A method as claimed in claim 1, further comrising in step (g) comparing each of said second quantities with each other to determine which one represents the furthest movement of said crusher cone in the direction of said crusher housing, and selecting that quantity as representing said new reference position.

5. A method as claimed in claim 1, further comprising in step (f), when repeating step (c), first moving said crusher cone to an opening position which is different from said reference position.

6. A method as claimed in claim 5, further comprising in step (g) after repeating step (c) in step (f), setting said opening position to be at a predetermined fixed distance from said new reference position.

7. A method as claimed in claim 1, further comprising the step of (k) automatically repeating steps (c)–(i) at preselectable timed intervals.

8. A method as claimed in claim 1, further comprising in step (d), before the first movement of said crusher cone toward said crusher housing, providing a time delay starting from interruption of a supply of material which is to be crushed.

9. A method as claimed in claim 1, wherein in step (d) further comprising first supplying a granular material of known coarseness of the gap between said crusher cone and said crusher housing, whereby said limit position is reached before direct contact occurs between said crusher cone and said crusher housing.

10. A method for adjusting the gap width between a rotatable crusher cone and a crusher housing, comprising the steps of:

(a) determining a reference position of the crusher cone relative to the crusher housing;

(b) storing a first quantity representative of said reference position;

(c) moving said crusher cone to said reference position;

(d) moving said crusher cone from said reference position toward said crusher housing until a limit position is reached, stopping the movement of said crusher cone toward said crusher housing when the limit position is reached, and measuring the distance between said reference position and said limit position;

(e) storing a second quantity representative of said distance;

(f) repeating steps (c)–(e) a plurality of times while separately storing each of the second quantities;

(g) obtaining an average of the values of said second quantities, and storing a new reference position which is representative of said average;

(h) determining an operating position of said cone crusher based on said new reference position;

(i) moving said crusher cone to said new operating position; and (j) performing steps (c)–(i) while continuously rotating said crusher cone.

* * * * *